United States Patent [19]

Landeck

[11] Patent Number: 4,966,059

[45] Date of Patent: Oct. 30, 1990

[54] APPARATUS AND PROCESS FOR HIGH SPEED WATERJET CUTTING OF EXTENSIBLE SHEETING

[75] Inventor: Harry A. Landeck, Tolland, Conn.

[73] Assignee: First Brands Corporation, Danbury, Conn.

[21] Appl. No.: 99,911

[22] Filed: Sep. 22, 1987

[51] Int. Cl.[5] ..... B26D 3/00

[52] U.S. Cl. ..... 83/53; 83/24; 83/98; 83/177

[58] Field of Search ..... 83/24, 53, 55, 98, 177, 83/428, 917; 493/227

[56] References Cited

U.S. PATENT DOCUMENTS

| | | | |
|---|---|---|---|
| 2,985,050 | 5/1961 | Schwacha | 83/53 X |
| 3,326,607 | 6/1967 | Book | 83/53 X |
| 3,526,162 | 9/1970 | Willcox | 83/53 X |
| 3,532,014 | 10/1970 | Franz | 83/53 X |
| 3,877,334 | 4/1975 | Gerber | 83/53 X |
| 3,978,748 | 9/1976 | Leslie et al. | 83/53 X |
| 4,048,885 | 9/1977 | Miyakita et al. | 83/53 X |
| 4,152,958 | 5/1979 | Bogert | 83/53 X |
| 4,248,110 | 2/1981 | Spivy | 83/53 X |
| 4,249,438 | 2/1981 | Kelley | 83/53 |
| 4,266,112 | 5/1981 | Niedermeyer | 83/53 X |
| 4,272,017 | 6/1981 | Franz | 83/53 |
| 4,567,796 | 2/1986 | Kloehn et al. | 83/53 |
| 4,573,382 | 3/1986 | Kloehn et al. | 83/53 |
| 4,693,153 | 9/1987 | Wainwright | 83/53 |

FOREIGN PATENT DOCUMENTS

| | | | |
|---|---|---|---|
| 1529165 | 10/1978 | United Kingdom | 83/53 |

*Primary Examiner*—Brian Healy

*Attorney, Agent, or Firm*—Gary L. Wamer

[57] ABSTRACT

A process and apparatus for high-speed waterjet cutting of moving extensible thermoplastic film at a selvage portion thereof wherein the film is supported during cutting by a solid support surface, the waterjet is captured in the course of cutting in an open passage within the support and the open passage is bounded by the support surface such that good quality cutting of the film is effected.

28 Claims, 10 Drawing Sheets

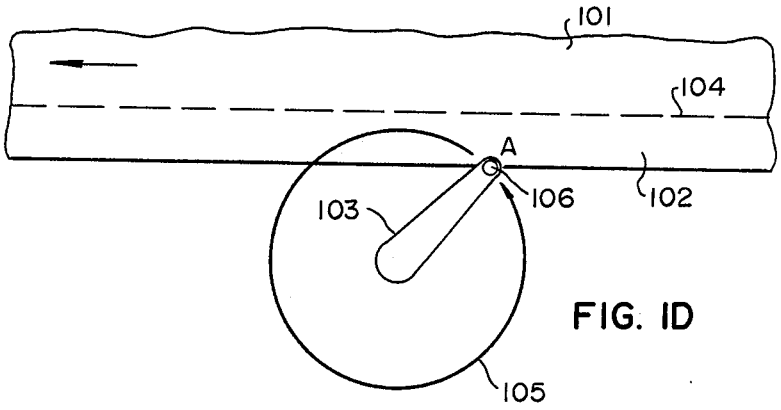
FIG. ID
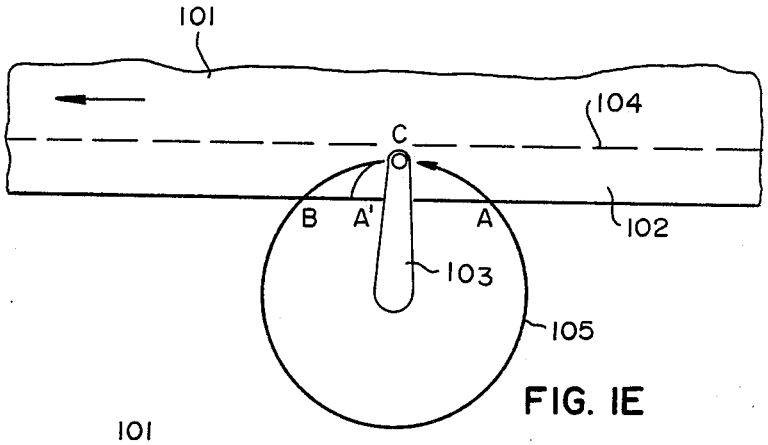
FIG. IE
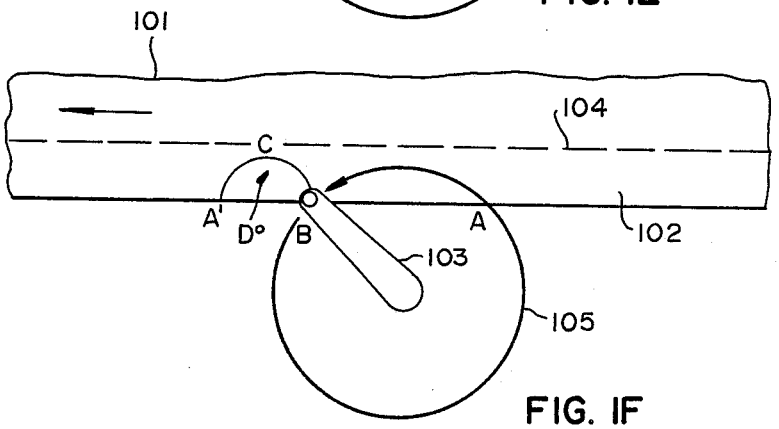
FIG. IF

APPARATUS AND PROCESS FOR HIGH SPEED WATERJET CUTTING OF EXTENSIBLE SHEETING

RELATED APPLICATIONS

Copending U.S. patent application Ser. No. 099,560, filed Sept. 22, 1987, now U.S. Pat. No. 4,903,559, commonly assigned and copending U.S. patent application Ser. No. 099,476, filed Sept. 22, 1987, now abandoned.

BRIEF DESCRIPTION OF THE INVENTION

High speed waterjet cutting about a single edge of a moving extensible sheeting material to effect repeated cuts in the material at about the edge, which comprises repeatedly (i) passing an edge and a portion interior of the edge of the moving sheeting material over a solid support surface within a cutting area;

(ii) laterally moving a waterjet cutting means comprising a waterjet nozzle over the cutting area and the solid support to cross the edge of the moving sheeting material within the cutting area over the solid support;

(iii) providing a water passage opening, in and bounded by the solid support, which (a) is in connected relationship with a water receptacle, and (b) is opposite of the water nozzle and registered therewith to follow the nozzle while over the cutting area;

(iv) waterjet cutting the material at about the edge, within the cutting area, by waterjet cutting the material from a point at least within the edge to another point within the same edge;

(v) synchronizing the relationship of the water jetting from the waterjet nozzle such that as the water passes through the material, it is captured in the water passage and removed to the water receptacle;

(vi) removing the waterjet cutting means from a position over the moving sheeting material;

(vii) maintaining any removable piece that is formed by the waterjet cutting within the sheeting material until the sheeting material is removed from the cutting area; and (viii) thereafter recovering the cut portion of the sheeting material from the cutting area from which is separated any such removable piece.

BACKGROUND TO THE INVENTION

In the aforementioned copending applications, a problem associated with high speed cutting of sheeting materials is overcome by effecting the cutting in the direction of movement of the sheeting material. Though this can solve a number of problems, there remains a special problem associated with the high speed cutting of relatively thin films of extensible materials, particularly the high speed cutting of relatively thin films of plastic materials such as thermoplastic films. The problem relates to the quality of the cut in the extensible material and the handling of discardable selvage. The term "relatively thin films" encompasses films having a thickness less than about 5 mils. Because extensible materials, by definition, can be stretched, they are particularly vulnerable when the cutting force has an unrestrained impact on the material. This can be visualized by the following:

If one holds a wide sheet of extensible film such as low density polyethylene at its edges but unrestrained in the interior portion, and then impacts a surface of the interior portion with a blunt instrument, the film will stretch in the direction of the impact. When the force of the impact is sufficient to cause a tear in the film, because the extensible material is sufficiently non-elastomeric so as not to regain its original shape, stretched portions of the film will reside at the tear and about the tear leaving a poor quality ragged cut in the material and a permanently deformed material in the area of the tear. As one reduces the bluntness of the instrument, less stretching occurs and the quality of the cut commensurately improves and permanent deformation is commensurately reduced. It is, however, not eliminated.

Waterjet cutting can be effected on such extensible materials. It can act as the aforementioned blunt instrument or as a less blunt instrument in cutting the material. Because it is a high pressure stream of water, it has the capacity of spattering, splashing, splaying, depending how it is used, and none of these three S's is favorable to its application as a cutting tool. For example, if one introduces a solid surface in its path, the stream will be deflected and subjected to all of the 3 S's. If the object being cut is an extensible thermoplastic film and is rested on a solid surface when it is waterjet cut, the waterjet stream will pound the solid surface after penetrating and cutting the film. The impact on the solid surface will cause the stream to be deflected in many directions, one of which will be back into the film being cut causing, as a minimum effect, movement of the film particularly about the area being cut and this forebodes distortions and unpredictable patterns in the cutting. This problem exists even if the solid surface is a thin wire, see Leslie, et al., infra. These kinds of problems are compounded when the cutting pattern moves lateral of a moving film and the line speed of the moving film is high, such as greater than 100 lineal feet per minute. They become even more severe problems when the waterjet cutter slices into and out of an edge of a film of an extensible thermoplastic material to cut out a part that is free to move from the film. If the cutting action throws water into the film, the cut out part can be tossed about the work area to potentially interfere with the cutting operation. If the line speed is high, viz. greater than 100 lineal feet per minute, air currents become an injected problem that can cause the cut part to move within and about the cutting operation thus introducing further potential interference with the cutting operation.

A problem associated with waterjet cutting is "splashback." It is dealt with by Leslie, et al, in U.S. Pat. No. 3,978,748, patented Sept. 7, 1976, according to the following:

> "The wires 32, spring steel about 0.015 inch in diameter support the workpiece while facilitating the cutting operation by preventing splash back and wetting of the workpiece. The wires are held in tension at a loading of approximately one-half the yield point of the steel. At this loading the grid adequately supports the material to be cut, but has sufficient[sic]ly elasticity to deflect when the fluid passes directly over it, thereby not being severed by the force of the fluid."
> "The use of a wire grid has been found to overcome one of the prime disadvantages of prior systems, splashback. As just pointed out, support of the workpiece is essential and in systems where merely straight cuts were being made, such as cutting logs, the material could be passed under the cutter on a table with a fixed discharge duct directly opposite the nozzle. However, for complex cutting operations, such as fabric patterns, it is obvious that a solid table cannot be employed least the material be completely saturated by the cutting fluid. One way to avoid the problem would be to hang the material vertically without a backing and cut horizontally, however, material handling problems result which make this type of cutting impractical for flexible goods. The use of a horizontal bed with the cutting action vertical is preferred and the use of a wire support bed makes this type of operation feasible. Trays, such as shown in FIG. 2, may be fabricated using a wire pattern of size and strength to facilitate the support of the material and to prevent pieces, once cut, from falling through the wires."

The splashback problem is associated with the use of a solid table supporting the material during the cutting action. The patentees were not aware of the issue of extensibility or were unconcerned by it because it was not the problem which the patentees had solved. These patentees dealt with the problem of water removal but not the effective support of the material so as to avoid the extensibility problem. Moreover, the patentees fail to mention that as the water spray passes over a supporting wire, a certain level of splashback is inevitable though evidently that level would be less than the level of splashback generated on a solid flat table.

Leslie, et al. deal with the water removal problem by providing a water catcher in registration with the waterjet cutter such that wherever the waterjet moves, so does the water catcher. The water catcher is located below the wire trays to catch the water that passes through the material and the tray. The water catcher in Leslie, et al. is not part of the support of the material being cut nor is it in open registration with the support such that no part of the support intervenes the material being cut and the water catcher.

Waterjet cutting has been used to cut extensible materials where either the piece that is being cut is moved or the waterjet cutting means is moved. There are known processes where both are moved in linear or essentially linear directions. For example, the cutter is moved essentially laterally of the piece or the waterjet cutting means is oscillated within a small arc laterally into a linearly moving film of extensible material.

There are products formed from plastic film that are produced in continuous runs. There are situations when a cut through an edge of the film is required in order to form the desired product. Such typically generates a disposable selvage. In the case of Kloehn, et al., U.S. Pat. No. 4,567,796, patented Feb. 4, 1986, and U.S. Pat. No. 4,573,382, patented Mar. 4, 1986, this is accomplished by the use of oscillating cutting devices which fail to follow in the direction of the movement of the object being cut. The patentees use waterjet cutting to trim the edge of a continuous run of plastic sheet to make the leg openings of a baby diaper. The continuous run of plastic is supplied on a conveyer of undefined description. The patent's drawings show the conveyers as endless belts, apparently of solid construction (the equivalent of a solid table). The patentees were either unconcerned with splashback and extensibility or were operating the waterjet cutter in a manner, such as at slow line speed, that the problems of splashback and extensibility could be accepted. The application filing dates of these patents was May 7, 1984, thus the technology is reasonably presumed to represent the current state of the art in waterjet cutting of extensible materials in a continuous operating mode.

Porter, U.S. Pat. No. 4,335,636, patented Jun. 22, 1982, utilizes waterjet cutting to cut gypsum boards and catches the water in a trough below the suspended board above it. The patentee avoided splashback, but the device used is not practical for the waterjet cutting of an extensible material as described above.

Niedermeyer, U.S. Pat. No. 4,266,112, patented May 5, 1981, fails to suggest the breadth of materials that the patent's process is expected to cut. The patent deals with "webs" and "materials," and only at col. 9, lines 11–13, does the patentee express some definition for those terms, with the following:

"With non-flexible materials such as expanded foam polyurethane plastic sheets, insulation, etc., certain downstream devices such as pull rolls can be used."

Expanded polyurethane foam is formed typically of thick sheets greater than about 30 mils. Though flexible polyurethane foams are made of extensible materials, rigid polyurethane foams need not be. The fact that the foam is defined as plastic sheets is an insufficient clue as to the actual identity of the materials being referred to by the patentee. Many rigid polyurethane foams are heat shapeable and, therefore, are properly characterized as plastics even though they would not be classed as thermoplastics.

Niedermeyer fails to suggest how the water of the waterjet, after cutting, is removed from the proximity of the material being cut. At best, the patentee suggests that the water is deflected to a trough, suggesting that a trough is the collection device. In every illustration, the material being cut is unsupported at about the area where cutting is being effected.

Miyakita, et al., U.S. Pat. No. 4,048,885, is directed to the use of waterjet cutting "of a moving sheet material having a large thickness and a large width which is difficult to cut with the conventional rotary shear although not impossible" (see col. 1, lines 44–47). As with the preceding prior art, little concern is shown for supporting the material, the handling of the splashback problem, the extensibility of the material and/or the removal of water from the cutting site.

Reciprocation or oscillation of a waterjet cutter rapidly into and out of an edge of a moving sheet of material produces a slanted slit having a gentle arc until the apex portion which is an abrupt curve that generates a parabolic slice defining a sharply formed or narrow apex (or tip). If such techniques are employed to effect a parabolic cut through a folded edge of a plastic or paper sheet, the unfolded sheet will not be an ellipse, but rather two (2) parabolas joined to form a hole and each juncture is an angle of about 30 or greater. At maximum line speed, this type of reciprocating cutting motion will typically create a poor quality cut because the cutting speed exceeds the speed at which the cutting stream most effectively cuts the material and because of the dynamic loads imposed on the cutter in the course of rapid cutter reciprocation which causes splaying of the cutter means during the turnaround. Kloehn, et al., U.S. Pat. No. 4,567,796, patented Feb. 4, 1986, and U.S. Pat. No. 4,573,382, patented Mar. 4, 1986. In order to vary the kind of cut performed by such cutters, it is necessary to cause them to alter their motion during the cutting action. This introduces complications in the mechanics of their operation. U.S. Pat. No. 4,573,382 describes the oscillation of a cutter into the sheeting and with cam arrangements varying the cutter's motion within the sheeting to elongate the hole that is cut. Such a cutting operation can impart high dynamic loads on the nozzle of the cutter which imposes stress on the cam system controlling the nozzle's movement. According to the patent, at col. 4, lines 13 et seq., cam means are put under great stress when used in oscillator waterjet cutters and "these stresses seriously limit the speed at which the web 6 can be cut. . ." To "minimize," but not necessarily overcome the problem, a "compromise cutting line" for the fluid jet is followed. Such apparently results in a compromise in the achievable cutting patterns, exhibiting the limitations of a process that places undue stress on the apparatus.

As pointed out previously, Kloehn, et al. fail to define a method for removing the water from the waterjet cutter from the cutting site. Water jetted into a solid surface will impose a detrimental stress on the waterjet cutter by the dynamic load transmitted back into the water stream as it ricochets from the solid surface. Thus, not only do the patents' process admittedly have to deal with stresses from the dynamic loads due to the oscillation action, it has to deal with the stresses imparted by the pressures generated at the solid surfaces where the cutting is taking place. The waterjet cutting process of these patents further suffer from the splashback problem and deformation of the thermoplastic film by virtue of water splaying on the solid support surface.

In addition, Kloehn, et al. fail to recognize the serious corrosion and surface deterioration problems introduced by the repeated pounding of a solid support surface by waterjet spray.

It would be desirable to be able to effect a repetitive selvage cut in a continuous run of a thermoplastic film without having to slow or stop the run and without distorting the cut selvage edge of the film.

It would be desirable to effect a cut in a sheeting material which is not limited by stresses imposed on the cutting means because of dynamic loads imparted by water ricocheting from any solid surface.

It would be desirable to effect a repetitive selvage cut in a continuous run of a thermoplastic film or films without suffering from splashback problems and generating raggedly cut edges.

This invention is directed to a process and apparatus for making a selvage cut in thermoplastic sheeting material which avoids the disadvantages of the prior art.

THE INVENTION

The invention is most broadly directed to a high speed waterjet cutting about a single "edge portion" of a moving extensible sheeting material to effect repeated cuts in the material at about the edge portion, which comprises repeatedly (i) passing an edge and a portion interior of the edge of the moving sheeting material over a solid support surface within a cutting area;

(ii) laterally moving a waterjet cutting means comprising a waterjet nozzle over the cutting area and the solid support to cross the edge of the moving sheeting material within the cutting area over the solid support;

(iii) providing a water passage opening, in and bounded by the solid support, which (a) is in connected relationship with a water receptacle, and (b) is opposite of the water nozzle and registered therewith to follow the nozzle while over the cutting area;

(iv) waterjet cutting the material at about the edge portion, within the cutting area, by waterjet cutting the material from a point at least within the edge portion to another point within the same edge portion;

(v) synchronizing the relationship of the water jetting from the waterjet nozzle such that as the water passes through the material, it is captured in the water passage and removed to the water receptacle;

(vi) removing the waterjet cutting means from a position over the moving sheeting material;

(vii) maintaining any removable piece that is formed by the waterjet cutting within the sheeting material until the sheeting material is removed from the cutting area; and (viii) thereafter recovering the cut portion of the sheeting material from the cutting area from which is separated any such removable piece.

The invention in a more preferred aspect is concerned with the process for high speed waterjet cutting about an edge portion of a moving thermoplastic extensible sheeting material to cut out a piece from the material, to be removed therefrom, which comprises the steps of:

(i) passing an edge and a portion interior of the edge of the moving sheeting material over a solid support surface within a cutting area;

(ii) laterally moving a waterjet cutting means comprising a waterjet nozzle over the cutting area and the solid support surface to cross the edge of the moving sheeting material within the cutting area over the solid support;

(iii) providing a water passage opening, in and bounded by the solid support surface, which (a) is in connected relationship with a water receptacle, and (b) is opposite of the water nozzle and registered therewith to follow the nozzle while over the cutting area;

(iv) waterjet cutting the material at the edge portion, within the cutting area, by waterjet cutting the material from a point at least within the edge portion to another point within the same edge portion;

(v) synchronizing the relationship of the water jetting from the waterjet nozzle such that as the water passes through the material, it is captured in the water passage and removed to the water receptacle;

(vi) removing the waterjet cutting means from a position over the moving sheeting material;

(vii) holding the removable piece to the support surface until the material is removed from the cutting area; and (viii) thereafter recovering the sheeting material freed of the removable piece.

The invention also encompasses an apparatus for making selvage cuts in a continuous manner in a continuous supply of sheeting. The apparatus contains:

(i) a movable waterjet cutter;

(ii) means for moving the waterjet cutter over a solid support surface such that the nozzle of the waterjet cutter faces the solid support surface;

(iii) means for receiving the selvage of a moving sheeting on the solid support surface in a position below said nozzle;

(iv) means for passing the waterjet cutter from one point on a selvage of the sheeting to another point on the selvage;
(v) an open space in the solid support surface positioned opposite of the position of the nozzle of the waterjet cutter which openly connects to a passage;
(vi) means for providing the open space in the solid support in registration with the movement of the waterjet cutter;
(vii) means for collecting water from the passage;
(viii) means for maintaining the cut portion of the selvage in position and in association with the sheeting upon removal of the waterjet from the selvage; and
(ix) optionally, means for separating any removable cut portion from the sheeting to provide a sheeting with a cut selvage.

The invention contemplates continuous repetition of the apparatus and the process to effect the high speed cutting of the aforementioned sheeting material

BRIEF DESCRIPTION OF THE DRAWINGS

FIGS. 1D, 1E, 1F, 1G, 1H and 1I schematically illustrate stages of making a primarily round cut by two procedures, FIGS. 1D–F, as one set of illustrations, and FIGS. 1G–I, as another set of illustrations, in a continous sheet of plastic with a rotating waterjet cutter.

DETAILS OF THE INVENTION

Figure 1A:
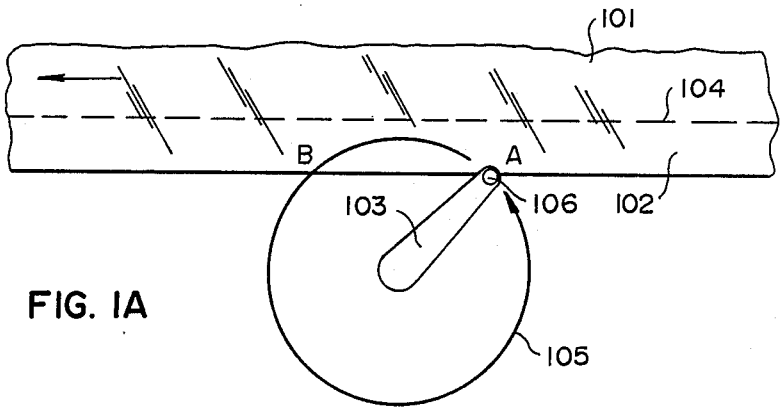
FIGS. 1A, 1B and 1C schematically illustrate stages of the making of a primarily round cut in a continous sheet of plastic with a rotating waterjet cutter.

The invention embraces a process and apparatus for effectuating the selvage cutting of a thermoplastic polymeric sheeting. The invention is primarily related to the selvage cutting of thermoplastic polymeric sheeting, defined as sheeting made of a thermoplastic polymer that has the capacity to be deformed by extension under the water pressure of waterjet cutting such that unsightly stretched portions of the polymer can be formed at the cut line when the polymer is waterjet cut. It is an object of this invention to minimize the occurrences of such unsightly stretched portions.

The term "selvage" embraces the edge portion of a sheet without defining its size. It typically refers to an edge portion in which a part is intended to be cut and discarded. In accordance with the terms of this invention, as set forth in this specification and the claims, the term selvage is not narrowly defined and embraces a side of the sheet extending from the center line thereof. This is a reasonable characterization of the term and is embraced by its normal definition because the size of a selvage, in any case, is dependent on a subjective standard. In addition, not all of the selvage need be cut. Only a portion of the selvage need be cut or a partial cut made in a portion of the selvage, in accordance with this invention. Moreover, the cut in the selvage need not generate a removable piece from the selvage, though in the preferred practice of this invention, the cut in the selvage results in the generation of a removable piece from the material.

The word edge is used herein and in the claims to mean "the line where an object or area begins or ends." The term edge portion is used herein and in the claims to mean the part of the sheeting near the edge and is inclusive of the edge. In its broadest connotation, the term edge portion includes that part of the sheeting extending from the center line to an edge of the sheeting.

The process and apparatus of the invention have the capacity of cutting out a portion of the sheeting from an edge portion of the sheeting or effecting a cut or series of cuts in the edge portion. In the latter case, the cut may constitute a single slice starting either from an edge, terminating at an edge or existing within the edge portion but removed from the edge. There may be a series of cuts as in a perforation so that the portion within the perforation may be torn from the sheeting.

In the preferred embodiment, the waterjet cutting is effected starting from a point at an edge of the sheeting and terminating at another point on the same edge so that the slit in the sheeting starts on the waterjet cutter's path over the edge of the sheeting and ends when the waterjet cutter is removed from a position over the sheeting by crossing the same edge.

Stated differently, the process of the more preferred aspect of the invention involves the cutting of at least a portion of a selvage of a sheeting containing a thermoplastic extensible polymer by a waterjet cutter wherein:
(i) the waterjet cutter, and its corresponding waterjet spray, is laterally passed over a selvage of the sheeting as the sheeting is moving over, and is supported by, a solid surface;
(ii) a water removal passage which comprises a open space on the support surface, sufficient to receive the whole of the waterjet spray, is positioned opposite of the positions of the waterjet cutter over the sheeting;
(iii) the waterjet spray, after it penetrates the sheeting, is removed through the water removal passage;
(iv) a removable selvage piece is created on the support surface the by cutting action of the waterjet spray;
(v) the removable selvage piece is held in place within the sheeting; and
(vi) the removable selvage piece is released from the sheeting when the piece is removed from the area of the action of the waterjet cutter.

The water removal passage has a size sufficient to remove the waterjet spray that cuts the piece, from the proximity of the sheeting. Its boundary with the solid support surface should not be too removed from the region of the cutting action, or else the sheeting will be unsupported by the solid surface—resulting in unnecessary permanent stretching about the cut edge and creating a ragged appearance. The purpose of the solid support surface is to provide support for the material about the periphery of the waterjet spray cutting through the material and thereby minimize the extent of permanent material stretching at the cut edge which would generate a generally ragged appearance under normal visual analysis. In the typical case, the perimeter of the open passage is bounded by the solid support surface. The closer that the size of the opening's width is to the diameter of the waterjet spray passing through the extensible material, and thence through the opening, the better will be the quality of the cut in the material.

The opening of the water removal passage in direct open register with the waterjet nozzle has a width which is not significantly greater than the diameter of the waterjet spray transmitted through the extensible material being cut. In the typical case, the width of the opening is not greater than about 8 times the diameter of the spray. Though the opening may be much longer than its width, thereby forming a slotted opening, the length of the opening is only long enough to accomodate the distance the waterjet spray is transmitted. In many embodiments of the invention, the opening is circular and the diameter of the opening in such instances is slightly greater than the diameter of the spray transmitted through the extensible material. In that case, the perimeter of the passage is preferably only slightly larger than the periphery of the waterjet spray. Broadly speaking, regardless of whether the opening is a round hole or a slot, it is preferable to have the width of the opening not greater than about 4 times that of the diameter of the waterjet spray passing therethrough and desirably not less than 1.2 times that of the diameter of the waterjet passing through it.

The exact size of the opening is dependent upon a number of factors such as the thickness of the film being cut, the speed of the moving film, the size of the cut in the film, the water pressure of the waterjet, the distance the waterjet nozzle is from the film, and the like considerations. In typical cases, the opening has been circular and ranged between about 0.025 to 0.25 inch.

The process and apparatus of the invention are most effective operating at line speeds of at least 100 feet per minute. The invention embraces, as a specific embodiment thereof, the processes and apparatus of the aforementioned copending patent applications which in their operation can achieve the process and apparatus of this invention. For example, the invention can include the apparatus and process for effectuating repeating patterns of arc cuts in a supply of an advancing sheeting continuously, and preferably rectilinearly, moving through a cutting area. They may comprise moving (with means to effect such movement) an omnidirectional cutter at a constant rate across the cutting area in a direction which is angular to the perpendicular of the rectilinear direction of the sheeting, imposing the cutting action (with means to effect such cutting) on the sheeting in the direction of movement of the sheeting within the cutting area to puncture the surface of the sheeting and making a cut therein, then passing (with means to effect such passing) the cutting means from the sheeting within the cutting area, and removing the cut portion of the sheeting from the cutting area by the continuous advancement of the sheeting. The process and apparatus of the invention can include arc cutting of the sheeting without undergoing the stop motion existing in reciprocating and oscillating cutting and cutters. However, the invention embraces as well the utilization of reciprocating and oscillating cutting and cutters, as well as cutting and cutters which operate to cut such sheeting by movement opposite to the direction of the sheeting, and is not limited to the particular omnidirectional cutting processes and apparatus of the copending patent applications.

The invention contemplates, in the preferred embodiment, the cutting of moving sheeting material with a waterjet cutter where the motion of the cutter during cutting of the material is simultaneously lateral and longitudinal such that the cutter repeatedly sweeps in a smooth and continuous arc motion over the sheeting material. The arc motion of the cutter is in the direction of travel of the sheeting material. A preferred feature of the invention is that the waterjet cutter moves at a velocity which is greater than the material being cut. A desirable feature of the invention, though less preferred, is that the waterjet cutter moves at a velocity which is equal to or less than the material being cut.

An advantage of the preferred embodiment of the invention is that it allows for high speed cutting while minimizing the degree of distortion (poor quality) in the cut in the sheeting, and such is effected without slowing down the directional speed of the sheeting (the productivity factor). The preferred embodiment of the invention operates by imparting to the cutter a directional velocity in the direction of the sheeting so as to minimize the advancing cutting action of the cutter on the sheeting and to eliminate making the cutting action dependent on the movement of the sheeting into the cutting means. By having the cutter move (as compared to a stationary position) in the direction of the sheeting, one alters the difference between their directional velocities and this difference in their directional velocities becomes the directional velocity of the cutting action. By controlling the relative directional velocity between the cutter and the sheeting one can control the quality of the cut in the sheeting. This, of course, is correlated with the cutting force of the cutting means to optimize the quality of the cut in the sheeting.

The preferred embodiment of the invention also provides that the directional velocity of the cutting means is greater than the directional velocity of the sheeting. A desirable feature of the invention, though less desirable than the preferred embodiment, provides that the directional velocity of the cutting means is equal to or less than the directional velocity of the sheeting. These assure, in the typical case, that the cutting action need not act to limit the line speed of an operation in which cutting is an integral part. This means that in the course of cutting, the cutting action will be effected at a directional speed which may be slower than, equal to or greater than the directional speed of the sheeting dependent on the geometry of the design. In the desirable feature of the invention, where the directional velocity of the cutting means is equal to or less than the directional velocity of the sheeting, the cutting action will be effected at a directional speed which is slower than or equal to the directional speed of the sheeting.

In the most preferred aspect of the invention, cutting in the sheeting is effected by the use of a revolving cutter action. Such materially reduces the dynamic loads on the cutter when it changes the cutting pattern to make a cut in the sheeting in a different direction. This allows one to effect higher speed cutting with less introduction of stress on the cutter than other cutting methods, such as reciprocal and oscillating cutting (see the previous discussion regarding U.S. Pat. Nos. 4,567,796 and 4,573,382). However, as previously pointed out, the invention in its broadest scope contemplates the use of reciprocal and oscillating waterjet cutting.

Another advantage of the preferred apparatus of the invention is that it can generate at high speed an arc cut in the sheeting material that can have a tangent which is parallel to the rectilinear direction of the sheeting material. A further advantage of the preferred embodiment of the invention is that it can generate at high speed an arc cut starting from an edge of the sheeting and terminating at a different point of the same edge in which the arc has a tangent which is parallel to the rectilinear direction of the sheeting. The preferred means of the invention generates such an arc cut.

The invention embraces inter alias a process for making a repetitive arc cut in a continuous manner in a continuous supply of sheeting possessing edges. In its implementation, a moving sheeting is passed across a cutting area and while the sheeting is in the cutting area, an arc-directed omnidirectional waterjet cutting means is passed in an arc-defined motion across a selvage of the sheeting in the direction of movement of the sheeting at a rate greater than, equal to or less than that of the directional velocity of the sheeting, to puncture at least a portion of the moving sheeting; maintaining the arc directed velocity of the omnidirectional cutting means at a rate (velocity) greater than, equal to or less than that of the directional velocity of the sheeting, such that the puncture is enlarged to a lineal cut. The most favorable application of the invention involves the use of waterjet cutting to cut curved slices and holes, especially primarily round holes, in multi-wall plastic constructions.

In one aspect, the invention encompasses an apparatus for making a repetitive arc cut in a continuous manner in a continuous supply of sheeting possessing edges. The apparatus involves means for receiving a moving sheeting having edges in a cutting area thereof, means for passing an arc-directed waterjet cutting means through the cutting area, over a selvage of the sheeting and in the direction of movement of the sheeting, at a rate greater than, equal to or less than the rate of the sheeting, means for puncturing the sheeting and initiating the cutting with the waterjet cutting means of the sheeting within the cutting area, means for withdrawing the waterjet cutting means from the area, and means for withdrawing the cut portion of the sheeting from the cutting area. To the above are provided the following improvements:

(i) means for moving the waterjet cutting means over a solid support surface such that the nozzle of the waterjet cutter faces the solid support surface;
(ii) means for receiving the selvage of a moving sheeting on the solid support surface in a position below said nozzle;
(iii) means for passing the waterjet cutter from one point on the edge of a selvage of the sheeting to another point on the edge of the selvage;
(iv) an open space in the solid support surface (preferably enclosed on all sides by the solid surface) which openly connects to a passage, positioned opposite to the position of the nozzle of the waterjet cutter;
(v) means for providing the open space in the solid support in registration with the movement of the waterjet cutter;
(vi) means for collecting water from the passage;
(vii) means for holding the cut portion of the selvage in association with the sheeting upon removal of the waterjet from the selvage edge; and
(viii) means for separating the cut portion from the sheeting to provide a sheeting with a cut selvage.

Sheeting, as used herein and in the claims, represents any three-dimensional material which possesses two opposite facing surfaces separated by edging surfaces. The edge of the sheeting may comprise the width of a single ply of material, the width of multiple plies of material, or the width of one or more plies of flattened tubular and/or folded-over materials. The opposite facing surfaces may be mono- or poly-planar and the combined surfaces typically (and preferably) posses many times the area of the edge surfaces. The sheeting employed in the practice of the invention may be made of any thermoplastic polymeric material capable of being cut by an omnidirectional waterjet cutter, and desirably is a thermoplastic polymer which could be extensible under water pressure of waterjet cutting of an unsupported film thereof such that stretched portions of the polymer can be formed at the cut line when the polymer is thusly waterjet cut. The preferred sheeting used in the practice of the invention are such extensible thermoplastic films, such as one or more layers of one or more of: polyethylene (low density, high density, linear low density and/or combinations), polypropylene, polyethylene copolymers (low density, linear low density and/or combinations), polybutylenes, ABS polymers, polyurethanes, polycarbonates, polysulphones, aliphatic polyamides, polyarylamides, polyaryletherketones, polyarylimideamides, polyaryletherimides, polyesters, polyarylates, polyoxymethylene, poly(epsilon-caprolactone), and the like. Composites of such films with a variety of materials is within the contemplation of the invention.

The invention provides the most significant benefits when the sheeting is made of a thermoplastic film having a thickness of less than about 5 mils and has a low secant modulus.

The invention embraces to novel apparatus for effecting the arc-directed cutting in a continuous supply of a sheeting, as aforedescribed.

A preferred apparatus of the invention for making a cut of at least a portion of the selvage involves the repetitive arc cut in a continuous manner in a continuous supply of sheeting possessing a selvage portion and comprises (a) means for receiving a moving sheeting having edges onto the solid surface of a cutting area thereof;
(b) means for passing an arc-directed waterjet cutter over the cutting area, over the area to be occupied by an edge of the sheeting;
(c) means for causing the waterjet of the cutter to puncture the sheeting located in the cutting area and effect a cut of the edge as it passes onto the edge, and continue the cut until the waterjet is withdrawn from the sheeting within the cutting area;
(d) means for withdrawing the waterjet cutter from the cutting area;
(e) means for maintaining the cut portion within the sheeting until the withdrawal of the sheeting from the cutting area;
(f) means for tracing within the support an open water removal passage corresponding to the position of the waterjet cutter over the sheeting which passage is enclosed by the support;
(g) means for withdrawing the cut portion of the sheeting from the cutting area; and
(h) means for repeating steps (a)–(g) inclusive.

The solid support surface comprises any surface which supports the extensible thermoplastic sheeting when it is being cut such that the sheeting is subjected to minimal stretching in the region of the cutting area at the time of cutting. Typically, the solid support surface is made of a rigid material capable of supporting the weight of the sheeting moving thereover. For example, the support surface may (1) provide support for any removable portion of the selvage after the cut in the selvage has been started,
(2) be totally solid, (3) have a cellular construction,
(4) contain rollers,
(5) be a composite structure, and/or
(6) have pores therein.

The purpose of the support surface is to provide a restraining surface about the perimeter of the water passage to support the thermoplastic sheeting when it is pushed into the waterjet stream so that the sheeting resists being permanently deformed in a gross manner at the cut edge. The size and shape of the support surface are not narrowly critical so long as the surface serves this purpose. The support surface may be flat or curved depending on the requirements of the cutting operation. Usually, the support surface will have a boundary radiating at least one-eighth inch, preferably one-quarter inch, more preferably one-half inch and most preferably, one inch from at least two sides of a theoretical four sides surrounding the perimeter of the water passage.

The preferred embodiment of the invention involves the lateral cutting of holes in the hem portion of plastic sheeting to be made into bags designed for inclusion of draw tapes. Such types of sheeting and bags are illustrated in U.S. Pat. No. 4,624,654, supra. The cutting device of this invention may be used as part of a multistep bag making assembly and process. The invention allows the high speed cutting in a hem portion of a plastic sheeting moving in a lineal direction at speeds of, e.g., greater than about 1.5, preferably 2.5, independent and full cuts per second. Whereas in the prior art, hole cutting in the manufacture of plastic draw tape bags constituted a rate limiting step in the manufacture of the bags, such no longer need be the case because of this invention.

Figure 1B:
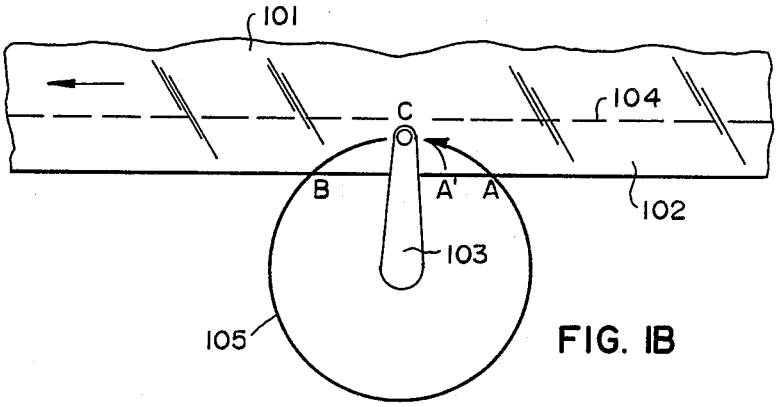
Figure 1C:
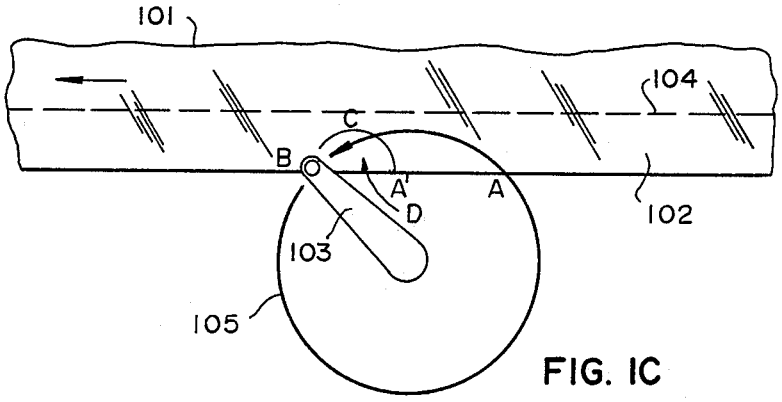

The principles of one embodiment of the invention are described in FIGS. 1A, 1B and 1C. Apparatus which achieve embodiments of the principles are depicted in FIGS. 2–8.

With respect to FIGS. 1A, 1B and 1C, is a plan view of the top of sheeting 101 which is a continuous plastic film (preferably polyethylene film) being moved continuously in the direction of the arrow (to the left) on a conveyor or roller combination, not shown. Suitable conveyors are endless belts, see U.S. Pat. Nos. 4,567,796, 3,614,369 and 4,335,636, or roller combinations such described in U.S. Pat. No. 4,624,654. Sheeting 101 contains a hem portion 102 in which the plastic is folded over to make a double layer of the plastic film which terminates at hatched line 104. Sheeting 101 can represent one or more layers of folded over plastic film, and in a preferred embodiment of making draw tape bag structures, it comprises two (2) such layers. Though the hem turns in the bottom direction, it could, in the practice of the invention, be turned in the top direction. In these figures, a waterjet cutting device 106 is revolved along path or circle 105 about the rotational axis of arm 103 in a counterclockwise direction, which is leftward in the indicated direction of travel of sheeting 101. The path of waterjet cutting device 106 is configured to cut across a portion of the hem region of sheeting 101. In FIGS. 1A, 1B and 1C, the line speed is selected to be 100 inches per second and the speed of revolution of waterjet cutting device 6 is selected to be 145.4 inches per second along path 105.

FIG. 1A shows that, as the cutting component of the cutting device 106 penetrates sheeting 101 within the hem portion(s), the intended arc of waterjet cutting device 106 is that between points A and B. However, FIG. 1B shows that the advancing film(s) reduces the relative cutting speed which is the difference between the speed of the cutting waterjet cutting device (constant in this case) and the speed of the advancing film (also constant in this case), and this shortens the distance of the arc such that the penetration point and the apex of the arc are defined by the curve A'C. If one measures cutting speed by a unit of measurement in a given time, the relative cutting speed of the sheeting in this case varies with the position of the cutting device 106 over the sheeting 101 and the cutting speed can vary from a higher and lower cutting speed, in the course of travel of cutting device 106, than the speed of sheeting 101. A differential of the natural arc of waterjet cutting device 106 and actual arc cut of device 106 is defined by the space ACA'. In the course of the downward swing from apex C of the waterjet cutting device 106 to point B of the natural arc, there is created the actual cut, arc BC. The time period from the initial penetration of sheeting 101, as shown in FIG. 1A, to the withdrawal of waterjet cutting device 106 from sheeting 101, as shown in FIG. 1C, is 0.05 seconds. If the hem(s) were to be opened up, such that the underside lies flat on the same plane as the remainder of the sheet, the primarily round cut defined as A'CB would be characterized as a mirror image to define a primarily round hole in the opened-up sheeting 101. The cutout piece D of the sheeting 101 which would be removed is hereinafter called the "slug".

An advantage of the system defined in FIGS. 1A–C, in which the cutting device 106 rotates in the direction of sheeting 101, resides in the handling of slug D. If the direction of cutting device 106 were in a clockwise direction and against the direction of sheeting 101, the initial penetration of sheeting 101 would have been at point B. As waterjet cutting device 106 would continue to penetrate into sheeting 101, the cut defined by line BC would have been basically unsupported as it moves forward. Such would cause the slug to vibrate and billow in response to the air currents generated about sheeting 101 at the speed characterized above and this would make slug handling a nuisance. This problem, of course, can be dealt with by introducing a complicated clamping device over the unsupported portion of the slug as it forms. Such is not needed when the cut is made in the direction of travel of sheeting 101 because the slug D that is being generated trails and is supported by the uncut portion of the sheeting. The slug is, therefore, not as susceptible to vibration and billowing factors. A hold down device is shown below for keeping the slug on the rotating table in order to remove it from the vicinity of the moving sheeting.

FIGS. 1A–C make apparent that, if cutting device 106 can be advanced simultaneously (a) in a rotational manner about the axis of arm 103 and (b) forward by the forward movement of the axis of arm 103 along an imaginary track parallel to and with the direction of sheeting 101, waterjet cutting device 106 can be made to generate a variety of different shape cuts in sheeting 101. That cut could be more extensive, generating a broader swathe across sheeting 101 and generating a larger hole in the hem portion. That motion, coupled with a slower rotational motion, could achieve the same cut as the semicircular A'CB as depicted in FIG. 1C. The nature of the arc-like cut in sheeting 101 can be significantly varied. Such variations can be extended by altering the angle relationship of the rotational plane of the cutting device 106 to the plane of the sheeting 101. It is also apparent that one can make an arc-like cut which has a deeper and more extensive penetration into sheeting 101 and/or by varying the direction of passage of cutting device 106, generate a cut in sheeting 101 which is considerably different from the semicircular cut depicted in FIG. 1C. A number of cam arrangements can be added to the apparatus to vary the position of the axis of arm 103 during the rotation of arm 103. Such can be used to cut a wide variety of designs in a moving sheeting. For example, the axis to arm 103 can be fixed in a rotatable slotted hole by a tensioning spring which in turn is bolted onto a cam follower that is locked into a track circumscribing a cam assembly. The cam assembly can provide a variety of cutting designs for the cutting device 106 to perform in sheeting 101, such as a fleur-delis. In addition, the cutting device 106 can be provided with a clutch mechanism that alters its speed in the course of cutting sheeting 101. For example, shortly after cutting device 106 penetrates sheeting 101, prior to point C, its speed of revolution can be slowed down for a short distance and then brought back up to the original speed. If this alteration in speed were repeated after point C, it is possible to generate a mushroom-like cut pattern in the hem 102. In addition to varying the travel of the cutting device 106 over the sheeting 101, the cutting device 106 can be designed to tilt in any direction as it travels over sheeting 101. In such a variation, if one is employing waterjet cutting, it is desirable to have the path for water removal appropriately positioned to accommodate the altered position of the cutting device. The variety of cutting patterns that one can generate is almost limitless. Using a combination of cam and clutch arrangements, it is possible to effect such a variety of cutting patterns without having to employ cam arrangements which cause high dynamic loads on the cutting device.

Figure 1G:
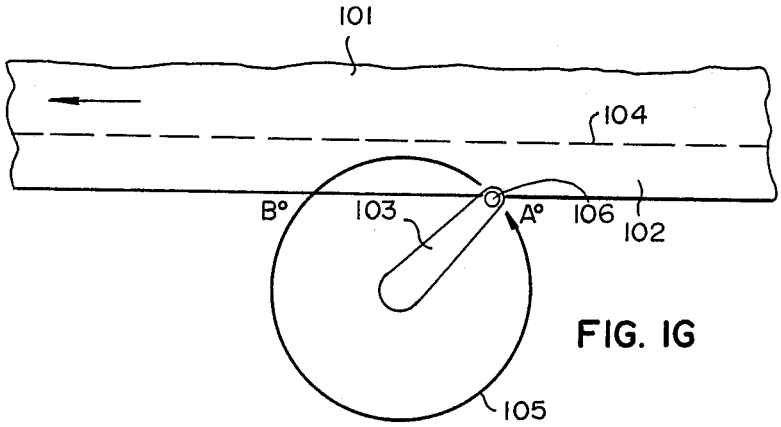
Figure 1H:
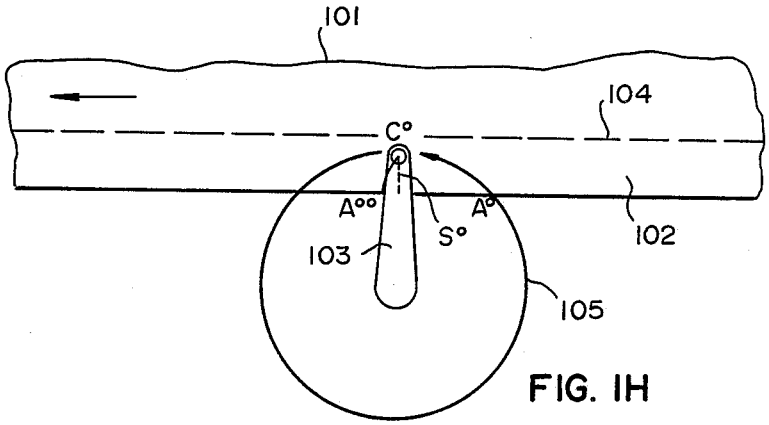
Figure 1I:
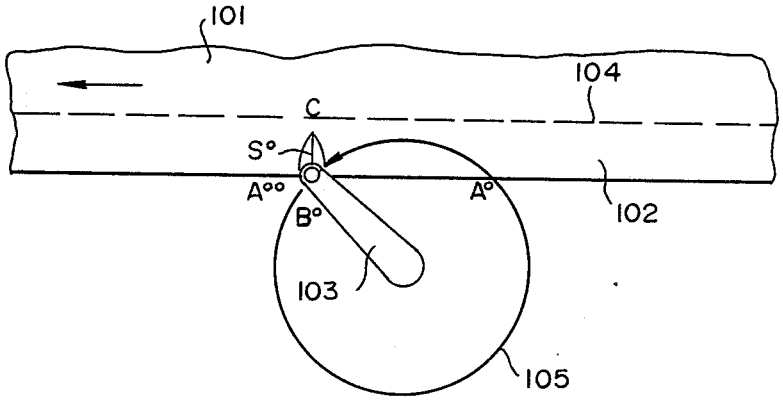

The principles of the desirable, but less preferred embodiment, of the invention are described in FIGS. 1D, 1E and 1F, as a set of illustrations, and FIGS. 1G, 1H and 1I, as another set of illustrations. Apparatus which achieve embodiments of the principles are depicted in FIGS. 2–8.

With respect to FIGS. 1D, 1E and 1F, as with FIGS. 1A–C, supra, are plan views of the top of sheeting 101 which is a continuous plastic film (preferably polyethylene film) being moved continuously in the direction of the arrow (to the left) on a converyor or roller combination, not shown. Suitable conveyors are endless belts and or roller combinations as pointed out above. Sheeting 101 contains the hem portion 102 in which the plastic is folded over to make a double layer of the plastic film which terminates at hatched line 104. Sheeting 101 can represent one or more layers of folded over plastic film, and in a preferred embodiment of making draw tape bag structures, it comprises two (2) such layers. Though the hem turns in the bottom direction, it could, in the practice of the invention, be turned in the top direction. In these figures, an waterjet cutting device 106 is revolved along path or circle 105 about the rotational axis of arm 103 in a counterclockwise direction, which is leftward in the indicated direction of travel of sheeting 101. The path of waterjet cutting device 106 is configured to cut across a portion of the hem region of sheeting 101. In FIGS. 1D, 1E and 1F, the line speed is selected to be 100 inches per second and the speed of revolution of device 106 is selected to be 82.21 inches per second along path 105, i.e., less than the line speed of sheeting 101.

FIG. 1D shows that, as the cutting component of the cutting device 106 penetrates sheeting 101 within the hem portion(s), the intended arc of waterjet cutting device 106 is that between points A and B. However, FIG. 1E shows that the advancing film(s) reduces the relative cutting speed which is the difference between the speed of the cutting device (constant in this case) and the speed of the advancing film (also constant in this case), so that the arc is reverse directed and the length of the arc is shortened such that the penetration point and the apex of the arc are defined by the curve A'C. If one measures cutting speed by a unit of measurement in a given time, the relative cutting speed of the sheeting in this case varies with the position of the cutting device 106 over the sheeting 101 and the cutting speed can vary from an equal and lower cutting speed, in the course of travel of cutting device 106, than the speed of sheeting 101. In the course of the downward swing from apex C of the waterjet cutting device 106 to point B of the natural arc, there is created the actual cut, arc BC. The time period from the initial penetration of sheeting 101, as shown in FIG. 1F, to the withdrawal of waterjet cutting device 106 from sheeting 101, as shown in FIG. 1F, is 0.092 seconds. If the hem(s) were to be opened up, such that the underside lies flat on the same plane as the remainder of the sheet, the primarily round cut defined as A'CB would be characterized as a mirror image to define a primarily round hole in the opened-up sheeting 101. Consistent with the preceding discussion, the cutout piece D of the sheeting 101 is termed the slug.

FIGS. 1G, 1H and 1I provide a plan view of the top of sheeting 101 characterized above. The waterjet cutting device 106 in these figures is revolved along path or circle 105 about the rotational axis of arm 103 in a counterclockwise direction, which is leftward in the indicated direction of travel of sheeting 101 at a speed equal to the speed of sheeting 101. The path of waterjet cutting device 106 is configured to cut across a portion of the hem region of sheeting 101.

FIG. 1G shows that, as the cutting component of the cutting device 106 penetrates sheeting 101 within the hem portion(s), the intended arc of waterjet cutting device 106 is that between points A° and B°. However, FIG. 1G shows that the advancing film(s) reduces the relative cutting speed which is the difference between the speed of the cutting device (constant in this case) and the speed of the advancing film (also constant in this case), so that the arc is minimal and the length of the arc is shortened such that the penetration point and the apex of the arc are defined by the curve A∞C°, closely approximating the area of straight line (hatched) S°. If one measures cutting speed by a unit of measurement in a given time, the relative cutting speed of the sheeting in this case varies with the position of the cutting device 106 over the sheeting 101 and the cutting speed can vary from an equal and lower cutting speed, in the course of travel of cutting device 106, than the speed of sheeting 101. In the course of the downward swing from apex C° of the waterjet cutting device 106 to point B° of the natural arc, there is created the actual cut, arc B°C°. If the hem(s) were to be opened up, such that the underside lies flat on the same plane as the remainder of the sheet, the primarily round cut defined as A∞C°B° would be characterized as a mirror image to define a relatively flat elliptical hole in the opened-up sheeting 101. The slug D° of the sheeting 101 is removable.

The invention contemplates the ability to effect an arc-like cut with any of the various waterjet cutters. Waterjet cutting is an extremely well defined art. There are a number of commercial waterjet cutting systems. Essentially all work pursuant to the same technology. Water is feed under high pressure, as high as 60,000 psi, through an extremely small nozzle having a diameter ranging from about 0.02 inch to about 0.003 inch (about 0.0508 cm to about 0.00762 cm). The water passes through the nozzle at more than twice the speed of sound creating a very concentrated force which is projected upon a very small area and this produces the puncturing or breakthrough effect upon whatever item to which the waterjet is projected. Water alone may be all that is required. This is dependent upon the particular item that is being subject to waterjet cutting. However, if the sheeting to be cut is more resistant to cutting by water, than an abrasive can be added to the water stream. Such abrasive allows waterjet cutting to be effective for steel of over three inches (3") thick and concrete of up to 12 inches in thickness. The technology of using abrasive materials for waterjet cutting is established.

One of the advantages of waterjet cutting is the size of the kerf generated. It is typically smaller than that generated by other omnidirectional techniques and, therefore, provides an additional benefit. The kerf is nominally in the 0.005" (0.0127 cm) to about 0.011" (0.02794 cm) range. In addition, waterjet cutting does not require a starting hole in order to initiate an arc-like kerf; therefore, kerfs, which are only arc-like cuts, can be introduced into the interior of sheeting without initiating the puncture at an outer edge. For example, with respect to FIGS. 1A–C, using waterjet cutting device 106, the kerf generated could be initiated at any point defined by arc A'CB. In the case of a hem-like structure, defined in FIGS. 1A–C, the kerf could extend from points A' to point C and then the waterjet cutting can be terminated. This would leave a semicircular kerf in the sheeting which could act as a flap, if a flap were desired for any particular application of the sheeting. Such flaps are commonly cut in large plastic or fabric display items used outdoors. The kerf generated could be a perforation, a series of holes along the same line.

FIGS. 2–8 illustrate apparatus which effectively utilize waterjet cutting in accordance with the process of the invention.

The apparatus of FIGS. 2–6 and 8 comprise a rotating table having a perimeter and having rotatively affixed thereto a waterjet cutting means openly connected to the perimeter of the table, which waterjet cutting means has a rotating axis aligned parallel with the axis of the table, and means for synchronizing the rotation of the cutting means with the position of the table during its rotation such that the revolution of the cutting means on the rotation of the table does not essentially change the facing direction of the cutting means. In the preferred apparatus of FIGS. 2–6 and 8, the drive for the rotation of the table is the drive for the synchronizing means.

Figure 2:
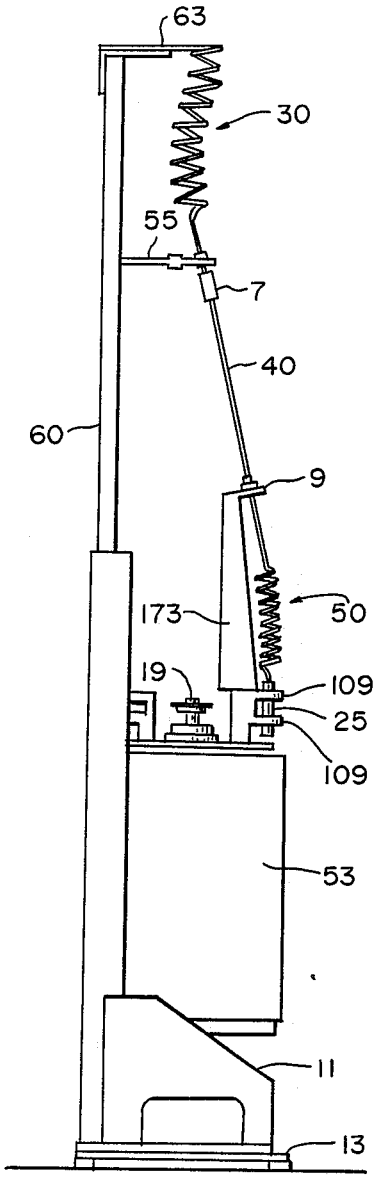
FIGS. 2–6 are various sectional views of a rotating waterjet cutter in which a variety of sheeting can be appropriately cut to provide an arc-directed cutting pattern in the sheeting. The cutter of FIGS. 2–6 is especially desirable for cutting essentially round-like holes in the hem of a draw-tape bag.

FIG. 2 is a side view of the significant components of a cutter apparatus of the invention which are further detailed in FIGS. 3–6 and 8. In FIG. 2 there is characterized cutter assembly 25 attached to waterjet supply coil tube section 50. The waterjet assembly 25 and the waterjet supply coil tube section 50 are affixed to support bracket 173 at bearings 9 and 109. The water supply to jet assembly 25 is effected through upper tube coil section 30, then through straightened tube section 40 and into waterjet supply coil tube section 50. The tubes are joined at coupling 7 and held in position by tube support bridge mounts 55 and 63. The whole tube assembly is locked into main tube support 60.

Associated with waterjet cutter assembly 25 is shaft assembly 19 and water catch tank 53. The whole apparatus is supported by slidable form platform 11 bolted through slots into a base plate 13 so that platform 11 can be moved forward and back one inch or more.

The principle involved in the operation of the cutting apparatus of FIG. 2 is as follows: Waterjet assembly 25 provides the waterjet stream which punctures and cuts the sheeting material. It follows that the sheeting material is passed under waterjet assembly 25. The sheeting can be supplied in a number of ways, such as on belt conveyors or on rollers, as mentioned above. The function of the conveyance is to move the sheeting continuously into and out of the cutter at the rate desired. Conventional belt conveyors and rollers are suitable. The water catch tank 53 has a function of collecting water emitted from waterjet assembly 25. The waterjet assembly 25 is caused to revolve, in a clockwise direction in a circular path as illustrated in FIGS. 1A–C, supra, by the rotation of the table on which it sits. The coil sections 30 and 50 of the water tubing serve to reduce stress caused by any torque imposed in the tubing during revolutions of the waterjet assembly 25. Waterjet assembly 25, while revolving in the clockwise direction, undergoes a rotation in the opposite direction such that its north-south position remains constant during each full revolution. As a result, a minimum amount of torque is imposed upon coil tube sections 30 and 50 and on tube section 40. Coil sections 30 and 50 assure flexibility in the water tube during revolution of waterjet assembly 25.

Figure 3:
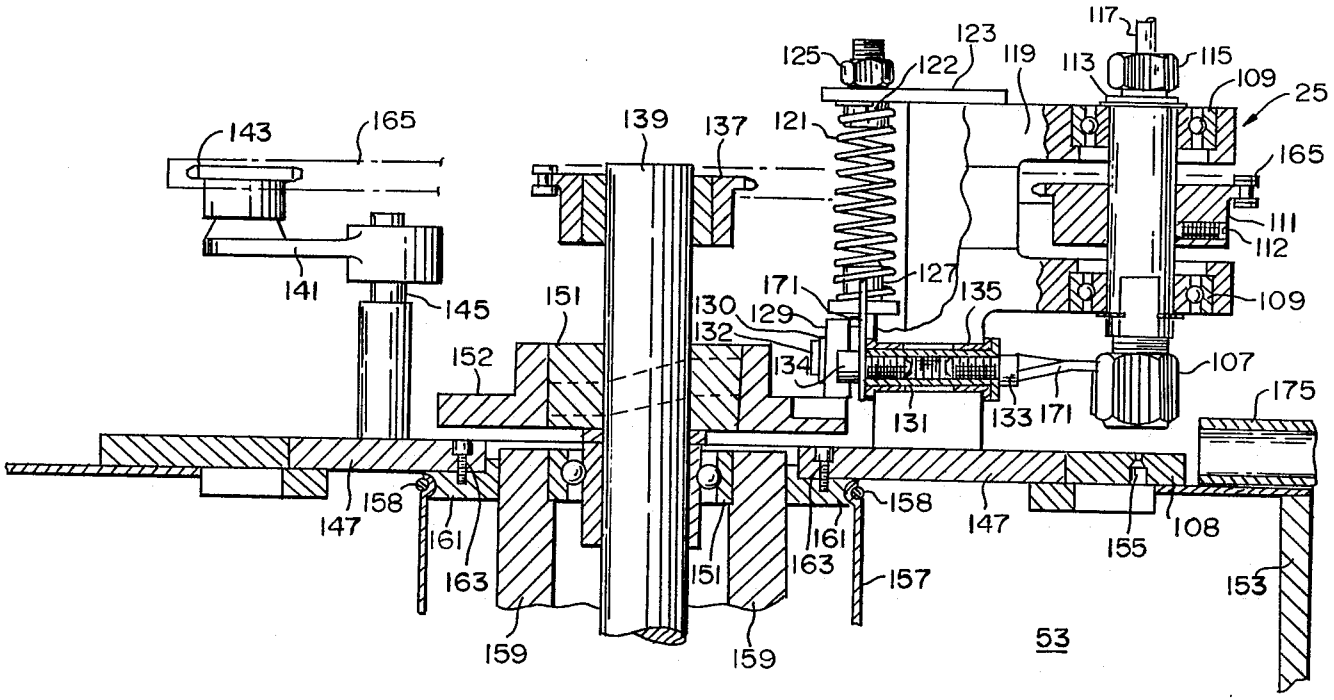
Figure 4:
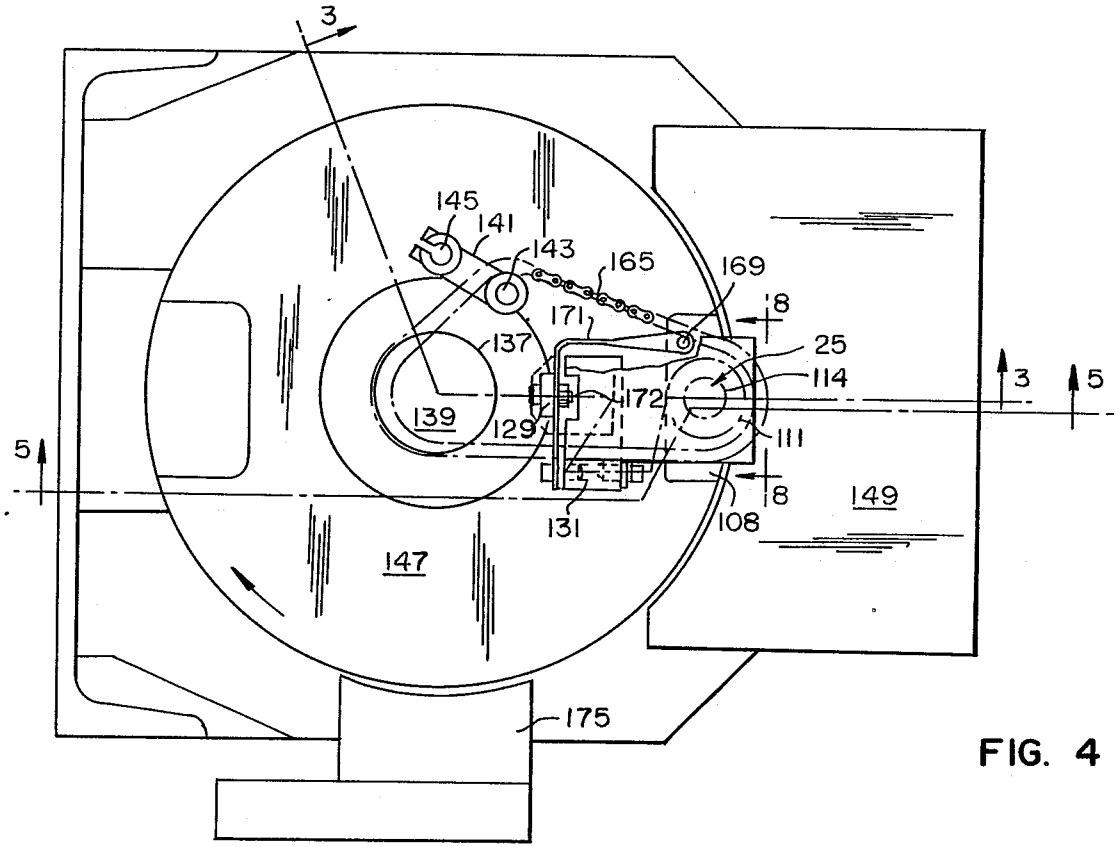

With respect to FIG. 3, taken along lines 3—3 shown in FIG. 4, there is shown a partial cutaway side view of waterjet assembly 25, the assembly for effecting the revolution and rotation of the waterjet assembly 25, and other components. Waterjet assembly 25 comprises bearings 109 and sprocket 111, roller chain 165, snap ring 113, tube holding nut 115 and connecting tube section 117 which forms part of the terminal portion of coil tube section 50. The bearings 109 form part of the waterjet housing assembly 119. Sprocket 111 is tightly secured to rotatively mounted waterjet passage section 114 by screw 112. The jet of water issues from waterjet nozzle 107. The diameter of the nozzle opening of waterjet nozzle 107 may range from 0.004 to 0.012 inch (0.001 to 0.031 cm), and for the cutting of multilayers of plastic film, an opening diameter of 0.005 inch (0.013 cm). Located below the waterjet nozzle is insert plate 108 in which is located a small hole characterized as water passage 155 which passes the water into tank 53. Water passage 155 may have a diameter of about 1/32 to about ⅛ inch (0.078 to 0.3175 cm). The size of passage is dependent on size of the nozzle 107 opening, the distance of nozzle 107 from passage 155 and the water pressure. If nozzle 107 is about ¼ inch (0.635 cm) from passage 155, using a pressure of 40,000 psi, passage 155 may have a diameter of 0.06 inch (0.152 cm). Insert plate 108 forms part of waterjet rotating mounting table 147. Waterjet housing assembly 25 is bolted (not shown) to waterjet rotating mounting table 147. Table 147 is bolted (via bolt 163) to rotatable shaft 159 via shaft flange 161.

At this stage in the characterization of FIG. 3, it is worthwhile to look at the top view offered by FIG. 4. One can see that as table 147 is rotated in the clockwise direction, the waterjet assembly 25 bolted to Plate 147 revolves to follow the rotation. Such action would cause an immediate twist to be imposed upon tubing section 117. To avoid this, there is provided means by which waterjet passage section 114 can be rotated simultaneously with the revolution of waterjet assembly 25 in a direction which removes the possibility of such torque action occurring. This is done by rotating section 114 in a counterclockwise direction such that its position (insofar as torque buildup is concerned) relative to tube 117 does not change.

In order to accomplish this, sprocket 111 is caused to rotate in a counterclockwise direction by connection with roller chain (having connected links) 165 which is looped about idler sprocket 143 and sprocketed bushing 137. The sprockets are the same size to insure the relative position of section 114. The chain link 165 circumscribes and is meshed with sprockets 137, 111 and 143. It is kept under tension by idler arm 141 mounted on idler shaft 145. Sprocketed bearing 137 is mounted on stationary shaft 139 which extends through waterjet tank 53. Rotatable shaft 159 is mounted to a motor and gear assembly (not shown) to cause the rotation of table 147. Shafts 159 and 139 are separated by bearing 151.

Located above table 147 and affixed to shaft 139 is bushing 151 containing cam surface 152. Cam surface 152 plays a part in the removal of the slug from the sheeting and does not play a part in the actual cutting activity of the waterjet cutter. Located to the side of the waterjet cutter is hold-down pin 169 which is controlled by the employment of cam surface 152 as discussed below. Pin 169 is hidden behind nozzle 107 in FIG. 3 and is shown to be on the counterclockwise side of waterjet assembly 25 in FIG. 4. It is connected to hold-down lever 171. Lever 171 tracks about the back of waterjet housing assembly 119, rides on the axle 130 of cam follower roller 129 and supports tracking spring 121. Lever 171 is rotatively affixed to rod 131 which is held in housing 135 by lock nuts 133 and 134.

Tensioning spring 121 is held in position by and between spring guides 122 and 127. Guide 127 sits on lever 171 and assures that follower roller 129 tracks cam surface 152. Spring 121 is held in position by retainer 123 screwed to housing 119. Nut 125 is screwed onto the threaded end of guide 122 to lock the spring onto retainer 123. Follower roller 129 rides on shaft 130 about bearings 132. Shaft 130 extends through lever 171 and its threaded portion extends on the other side of lever 171 where it is bolted in position by bolt 172, see FIG. 4.

Affixed to the top of water catch tank 53 is dead plate 149. It serves to support the sheeting as it is fed between the mounting table 147 and the waterjet nozzle 107. As the slug is cut in the sheeting by the water stream issuing from waterjet nozzle 107, it is held in position on table 147 by hold-down pin 169 and separated from the sheeting by the rotation of table 147. It is transported to the position of vacuum nozzle 175 which is connected to a vacuum assembly (not shown). The proper location of vacuum nozzle 175 is shown in FIG. 4. It height relative to mounting table 147 is characterized in FIG. 3. At this point, follower roller 129 is caused to rise by a rise in cam surface 152 and this lifts lever 171 which lifts pin 169 from the slug. This releases the slug and it is drawn by the vacuum into vacuum nozzle 175 from table 147. From that point until pin 169 is again over the sheeting, it is kept in an "up" position. As the waterjet crosses over the sheeting, pin 169 is caused by cam surface 152 and roller 129 to drop onto and frictionally affix the slug to table 147. The sequence is thereafter repeated.

The actual positioning of hold-down pin 169 may be the reverse of that shown in the drawings in the practice of the invention when the arc directed velocity of the waterjet cutter is at a rate (velocity) equal to or less than that of the directional velocity of the sheeting or the waterjet cutter revolves in a direction opposite to that of the sheeting. In that case, it is desirable that the hold-down pin 169 be on the clockwise side of the waterjet assembly 25 so that the plug is held in position almost immediately after the waterjet spray initiates the cut in the sheeting. In order to effectuate this, the arrangement of the lever 171 and the cam surface 152 are suitably modified.

If the slug in any embodiment is difficult to withdraw from table 147 into the vacuum nozzle 175, one may provide an air "puff" to assist the slug from the table so that it can be caught up in the vacuum. This can be effected by incorporating an air outlet from a compressor in a location in table 147 where the slug is formed and releasing a puff of air into the slug when it is transported to the vicinity of the vacuum nozzle 175 to assist in its removal from table 147.

Tank 53 is a cylindrical tank which contains in its central interior shafts 139 and 159. They are protected there by skirt 157 which is held to flange 161 by hold-down wire ring 158. Below the interior of skirt 157 is splash guard 162 which circumscribes both shafts. Water is collected within tank 53 between tank wall 153 and splash guard 162, and withdrawn through a port (not shown) at the bottom of the tank.

Figure 5:
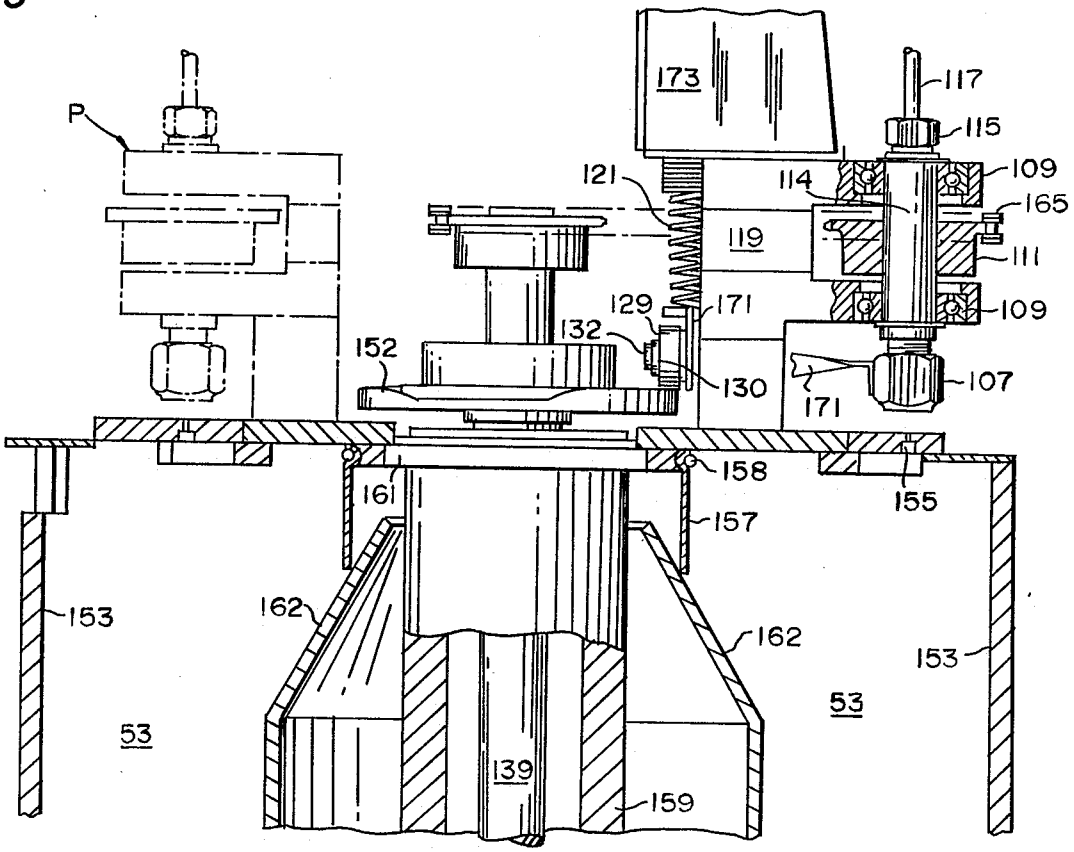
Figure 6:
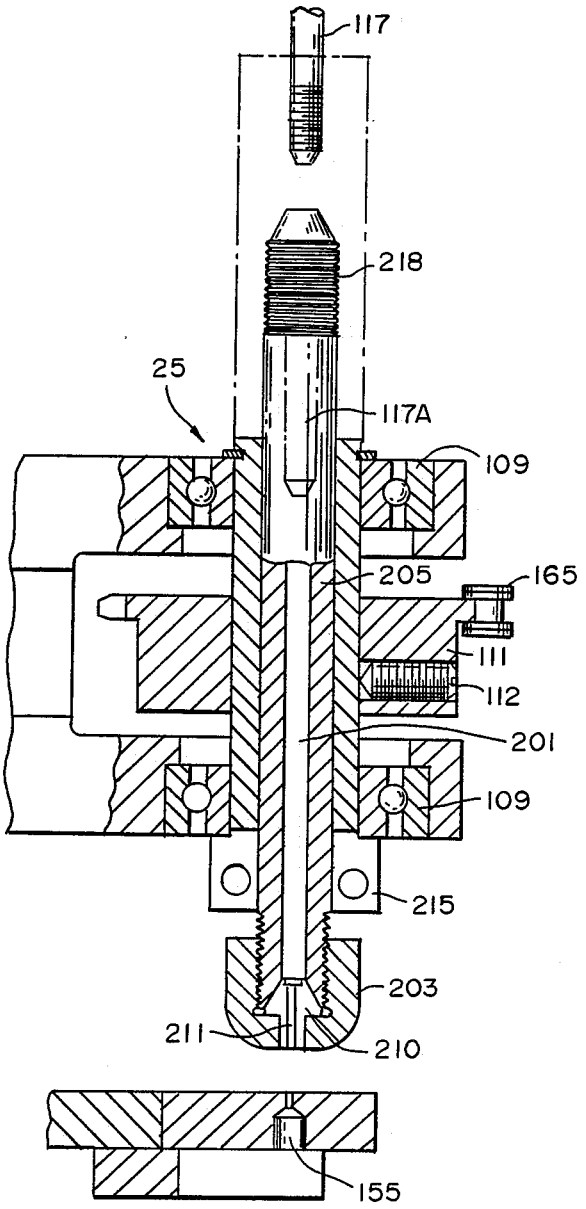

FIG. 4 is a top view which characterizes the relationship of the rotatable table 147 and waterjet assembly 25, as well as the position of vacuum nozzle 175. FIG. 5, which is a cross sectional and partial cutaway taken along lines 5—5 of FIG. 4 of the apparatus of FIG. 2, gives further details of the water tank 53, the shafts 159 and 139, splash guard 162 and skirt 157. It also shows the relationship of support bracket 173 to assembly 119 and, in phantom, P, displays the position of housing assembly 119 and waterjet assembly 25 as the table 147 is rotated such that the waterjet assembly 25 is positioned opposite to that necessary to effect arc-like cutting of sheeting passed continuously through the cutting device. FIG. 6 is a cross-sectional view of an alternative of a waterjet nozzle assembly 25. It shows bearings 109 and sprocket 111 to which is affixed chain 165. The waterjet assembly comprises a metal pipe 205 with cylindrical internal water passage 201 leading from tube section 117 to screwed-on nozzle 203. In FIG. 6, tube section 117 thread fits in position 117A in the interior in of pipe 205 flush to passage 201. Pipe 205 is provided with threaded section 218 so that section 117 is secured within pipe 205 by nut 115. Nozzle 203 is provided with nozzle nut 210 which retains nozzle orifice 211. Circumscribing pipe 205 is nozzle sleeve 215 which holds the nozzle in the bearings.

Water supplied to the waterjet assembly 25 can be effected with any of the commercially available waterjet systems. A number of commercially available systems are described in PIM&E, Jul. 1986, Modern Plastics, Sept., 1986, Managing Automation, Mar., 1987. Useful descriptions of waterjet systems can be found in Olsen, Cutting By Waterjet, Feb., 1980, published by Flow Systems, Inc., Kent, Wash. 98031.

Certain sheeting materials, to be cut according to the invention, require the use of abrasives. This is particularly the case where the sheeting material is a composite, metal or ceramic. Abrasives can be provided in the process of the invention in accordance with techniques well known in the art; see Hashish, Application of Abrasive Waterjet to Metal Cutting, Jan. 1, 1986, published by Flow Industries, Inc., Kent, Wash. 98032 and Adams, Waterjet Machining of Composites, Jan., 1986 conference (Los Angeles, Calif.), published by Society of Manufacturing Engineers, Dearborn, Mich. 48121.

The orifice of the waterjet nozzle may be made of abrasive resistant materials such as stainless steel, sapphire, diamond, tungsten carbide and the like. The interior water passage may be made of a variety of materials ranging from stainless steel, nickel-stainless steel alloys, tungsten carbide, and the like. Sapphire and tungsten carbide coated orifices are the preferred waterjet nozzles.

In those cases where there is a desire to effect a cut in the edge portion that fails to generate a removable piece from the sheeting, it is desirable to introduce the capacity to stop and/or start the waterject cutter as it traverses the cutting area. By this procedure, the cut can be initiated at an edge or within an edge portion. Such a technique can be used to produce a plurality of cuts within the edge portion as in the case of a perforated cut of the sheeting. The means for doing this is commercially available. There is a cutting device called Instajet TM, made by Flow Systems, Inc., Kent, Wash. 98031. It comprises a pneumatically actuated, normally closed, on/off valve integrated with a waterjet nozzle assembly. Its five basic components comprise an actuator, a valve body, a poppet (lift valve) assembly, an orifice mount assembly and the nozzle nut. Such a device can be used in place of assembly 25.

Figure 7:
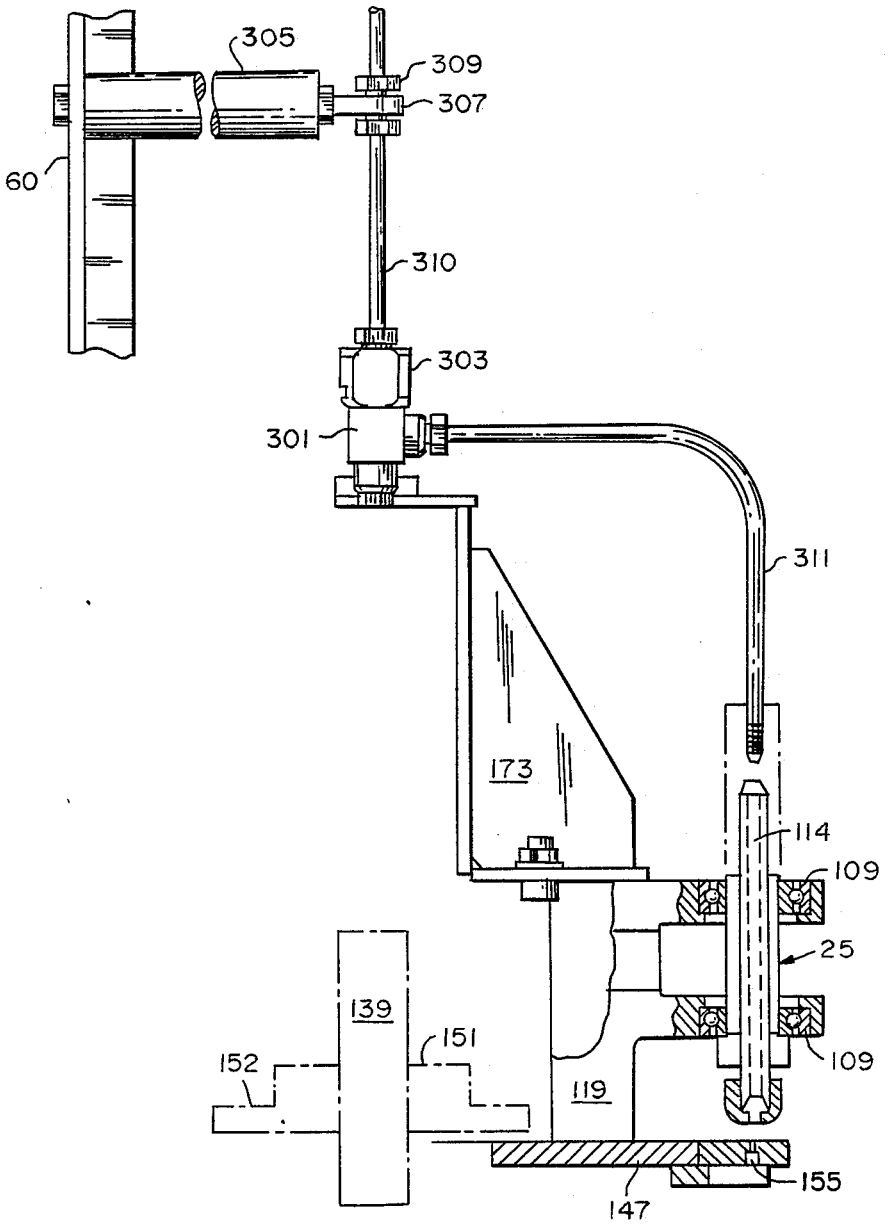
FIG. 7 is a sectional view of an alternative cutter assembly to that depicted in FIGS. 2–6.

FIG. 7 is a partial cross-sectional view of a modification in water supply lines feeding waterjet assembly 25. Its primary difference resides in operating the cutter without the sprocket-chain assembly shown in FIGS. 2–6. Torque elimination is achieved by joining feed tube 311 from waterjet assembly 25 to high pressure rotary union 301 which, in turn, is connected to tube coupler 303 to fix water supply tube 310 in open relationship with union 301 and tube 311. Tube 310 is supported by tube coupler 309, held in position by rod end 307. This water feed assembly is supported by bridge mount 305 which is bolted to frame 60. The rotary capability of union 301 allows tube 311 to track the revolutions of assembly 25 without inducing torque in the tubing. The major problem with this apparatus configuration is the vulnerability of union 301 to withstand the high water pressures employed in the process.

Figure 8:
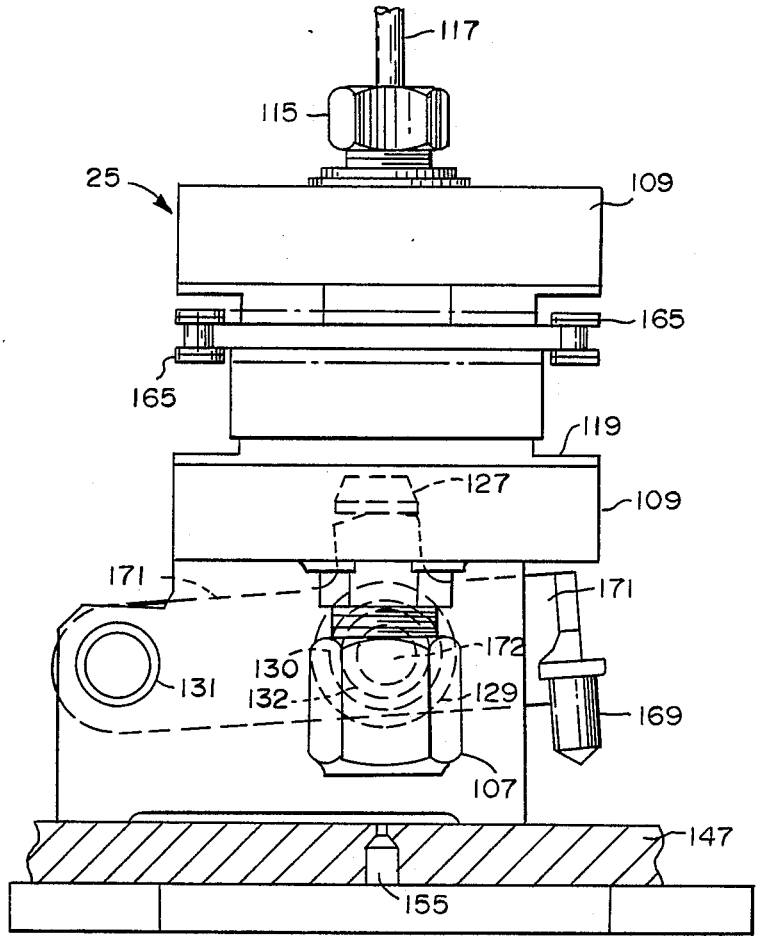
FIG. 8 provides a sectional view of the apparatus of FIGS. 2–6 along line 8—8 in order to better show the hold down device.

FIG. 8 is a cross section of FIGS. 2–6 along line 8—8 of FIG. 4. Located to the side of the waterjet cutter assembly 25 (note relationship to nozzle 107) is hold-down pin 169 which is controlled by the employment of cam surface 152. Pin 169 is beside nozzle 107 in FIG. 8 and is shown to be on the counterclockwise side of waterjet assembly 25 in FIG. 4. It is connected to hold-down lever 171. Lever 171 tracks about the back of waterjet housing assembly 119, rides on the axle 130 of cam follower roller 129 and supports tracking spring 121, as stated above. Lever 171 is rotatively affixed to rod 131 which is held in housing 135 by lock nuts 133 and 134, as mentioned previously.

The hold-down device need not rely on positive pressure to hold the material to the solid support surface. For example, a vacuum line can be incorporated into the support with its outlet or outlets (nozzles) located at the surface on which the material lays during the cutting action. The negative pressure can be low enough to hold the cut piece in place during the cutting, but not great enough to prevent the rest of the sheeting from being moved. The cut piece will serve to block the nozzle until the negative pressure is cut off.

When the waterjet cutter is reciprocated or oscillated into the sheeting, the water passage can be accommodated to track it in much the same manner characterized in FIGS. 2–8. The water passage can be affixed to and controlled by a cam arrangement similar to that affixed to and controlling the waterjet cutter. In such an assembly, the water passage may be part of a slide system in the surface of the support. In such a device, two flat plates are aligned essentially in the plane of the support surface in a slotted passage in the support that allows them to track the movement of the water passage opening at the front and back thereof. The plates can define part of the water passage opening's perimeter. The remainder of the perimeter of the water passage opening is defined by the support surface at the perimeter of the slotted passage. The water passage may be a flexible and expandable tube which on one end is connected to the slidable plates and forms an opening in the support's surface and, on the other end, is connected and opens to the water receptable. The slotted passage forms a path in the support that allows the tube opening at the support's surface to track the waterjet cutter. The sliding plates are mounted (such as by tongue and groove mounting in which bearings are provided) in the slotted passage and at one end of each terminate at the tube's opening and are securely affixed to the tube. The plates serve to cover the slotted passage not occupied by the tube's opening and they are moved with the tube by the cam action.

In another embodiment, the slotted passage employed in a reciprocating or oscillating waterjet cutter, may be just an open slot in the surface of the support which is aligned to track the movement of the waterjet cutter during its operative period of cutting the sheeting. In such an embodiment, the width of the opening in the direction of the cutter is slightly greater than the diameter of the water spray which penetrates and cuts the sheeting. A vacuum nozzle can be located along the path of the sheeting just after the cutting area in such an embodiment. In that case, the sheeting is passed over the vacuum nozzle opening and the removable slug is pulled away from the sheeting by the vacuum. The downstream edge of the nozzle's opening is cut away to allow clearance of any portion of the retained selvage that is drawn down in the direction of the nozzle's opening. The vacuum nozzle, in that location, serves the dual purpose of acting as a hold down device for the slug until it clears the cutting area and the slug is positioned for effective removal from the sheeting.

I claim:

1. The process for high speed waterjet cutting about a single edge of a moving extensible sheeting material to effect repeated cuts in the material at about the edge, which comprises repeatedly (i) passing an edge and a portion interior of the edge of the moving sheeting material over a solid support surface within a cutting area;

(ii) laterally moving a waterjet cutting means comprising a waterjet nozzle over the cutting area and the solid support to cross the edge of the moving sheeting material within the cutting area over the solid support;

(iii) providing a water passage opening, in and bounded by the solid support, which
(a) is in connected relationship with a water receptacle, and
(b) is opposite of the water nozzle and registered therewith to follow the nozzle while over the cutting area;

(iv) waterjet cutting the material at about the edge, within the cutting area, by waterjet cutting the material from a point at least within the edge to another point within the same edge;

(v) synchronizing the relationship of the water jetting from the waterjet nozzle such that as the water passes through the material, it is captured in the water passage and removed to the water receptacle;

(vi) removing the waterjet cutting means from a position over the moving sheeting material;

(vii) maintaining any removable piece that is formed by the waterjet cutting within the sheeting material until the sheeting material is removed from the cutting area; and (viii) thereafter recovering the cut portion of the sheeting material from the cutting area from which is separated any such removable piece.

2. The process of claim 1 wherein the water passage opening has a width which is not significantly greater than the diameter of the waterjet spray transmitted through the extensible material being cut.

3. The process of claim 2 wherein the width of the water passage opening is not greater than 8 times that of the diameter of the waterjet spray transmitted through the extensible material.

4. The process of claim 1 wherein the waterjet cutter travels in an arc directed motion across the edge of the sheeting material.

5. The process of claim 1 wherein the waterjet cutter travels in a reciprocating motion across the edge of the sheeting material.

6. The process of claim 1 wherein the waterjet cutter travels in an oscillating motion across the edge of the sheeting material.

7. The process of claim 1 wherein there is formed a removable piece formed in the material.

8. The process of claim 1 wherein there is no removable piece formed in the material.

9. The process for the high speed waterjet cutting about an edge of a moving thermoplastic extensible sheeting material to cut out a piece from the material, to be removed therefrom, which comprises:

(i) passing an edge and a portion interior of the edge of the moving sheeting material over a solid support surface within a cutting area;

(ii) laterally moving a waterjet cutting means comprising a waterjet nozzle over the cutting area and the solid support surface to cross the edge of the moving sheeting material within the cutting area over the solid support surface;

(iii) providing a moving water passage opening, in and bounded by the solid support surface, which
(a) is in connected relationship with a water receptacle, and
(b) is opposite of the water nozzle and registered therewith to follow the nozzle while over the cutting area;

(iv) waterjet cutting a removable piece of the material at the edge, within the cutting area, by continuously waterjet cutting the material from one point at the edge to another point on the same edge;

(v) synchronizing the relationship of the water jetting from the waterjet nozzle such that as the water passes through the material, it is captured in the water passage and removed to the water receptacle;

(vi) removing the waterjet cutting means from a position over the moving sheeting material;

(vii) maintaining the removable piece with the material until the material is removed from the cutting area; and (viii) thereafter recovering the sheeting material freed of the removable piece.

10. The process of claim 9 wherein the water passage opening has a width which is not significantly greater than the diameter of the waterjet spray transmitted through the extensible material being cut.

11. The process of claim 9 wherein the width of the water passage opening is not greater than 8 times that of the diameter of the waterjet spray transmitted through the extensible material.

12. The process of claim 9 wherein the waterjet cutter travels in an arc directed motion across the edge of the sheeting material.

13. The process of claim 9 wherein the waterjet cutter travels in a reciprocating motion across the edge of the sheeting material.

14. The process of claim 9 wherein the waterjet cutter travels in an oscillating motion across the edge of the sheeting material.

15. The process of cutting at least a portion of a selvage of a sheeting containing a thermoplastic extensible polymer by a waterjet cutter comprising:

(i) laterally passing the waterjet cutter and the corresponding waterjet over a selvage portion of the sheeting as it is moving over and is supported by a solid surface;

(ii) moving within the solid surface a water removal passage that comprises an open space on the support surface, sufficient to receive the whole of the waterjet, to positions which correspond oppositely to the positions of the waterjet cutter over the sheeting;

(iii) removing the waterjet that penetrates the sheeting through the water removal passage;

(iv) generating a removable selvage piece on the support surface;

(v) holding the removable selvage piece in place; and (vi) releasing the removable selvage piece from the sheeting when the piece is removed from the area of the action of the waterjet cutter.

16. The process of claim 1 wherein the water removal passage opening is of a size sufficient to remove the waterjet spray that cuts the piece from the proximity of the sheeting but is not so large that in the region of the cutting action the sheeting is sufficiently unsupported by a solid surface to generate unnecessary permanent stretching about the cut edge which presents a ragged visual appearance.

17. The process of claim 1 wherein the solid support surface provides support for the material about the perimeter of the waterjet cutting through the material.

18. The process of claim 17 wherein there is a minimization of the extent of permanent material stretching at the cut edge which would generate a generally ragged appearance under normal visual analysis.

19. The apparatus for making a selvage cut in a continuous manner in a continuous supply of extensible thermoplastic polymeric sheeting containing (i) a movable waterjet cutter;

(ii) means for moving the waterjet cutter over a solid support surface such that the nozzle of the waterjet cutter faces the solid support surface;

(iii) means for receiving the selvage of a moving sheeting on the solid support surface in a position below said nozzle;

(iv) means for passing the waterjet cutter from one point on the edge portion of a selvage of the sheeting to another point on the edge portion of the selvage;

(v) an open space in the solid support surface positioned oppositely to the position of the nozzle of the waterjet cutter which openly connects to a passage;

(vi) means for maintaining the open space in the solid support in registration with the movement of the waterjet cutter;

(vii) means for collecting water from the passage;

(viii) means for maintaining the cut portion of the selvage in association with the sheeting during the passage of the waterjet cutter about the selvage and immediately upon removal of the waterjet from the selvage edge; and (ix) means for recovering a sheeting with a cut selvage.

20. The apparatus of claim 17 wherein the waterjet cutter travels in an arc directed motion across the edge of the sheeting.

21. The apparatus of claim 17 wherein the waterjet cutter travels in a reciprocating motion across the edge of the sheeting.

22. The apparatus of claim 17 wherein the waterjet cutter travels in an oscillating motion across the edge of the sheeting.

23. The apparatus of claim 20 wherein the waterjet cutter travels in a rotational are directed motion across the edge of the sheeting.

24. The apparatus of claim 23 wherein the rotational arc is in the direction of the sheeting.

25. The process of claim 4 wherein the waterjet cutter travels in a rotational arc directed motion across the edge of the sheeting.

26. The process of claim 25 wherein the rotational arc is in the direction of the sheeting.

27. The process of claim 25 wherein the rotational arc is in the direction opposite to that of the sheeting.

28. An apparatus for making a cut of at least a portion of the selvage of a thermoplastic sheeting which involves the repetitive arc cut in a continuous manner in a continuous supply of sheeting possessing a selvage portion and comprises:

(i) means for receiving a moving sheeting having edges onto the solid surface of a cutting area thereof;

(ii) means for passing an arc-directed waterjet cutter over the cutting area, over the area to be occupied by an edge of the sheeting;

(iii) means for causing the waterjet of the cutter to puncture the sheeting located in the cutting area and effect a cut of the edge as it passes onto the edge, and continue the cut until the waterjet is withdrawn from the sheeting within the cutting area;

(iv) means for withdrawing the waterjet cutter from the cutting area;

(v) means for holding the cut portion onto the solid surface of the cutting area until the withdrawal of the sheeting from the cutting area;

(vi) means for tracing within the support an open water removal passage corresponding to the position of the waterjet cutter over the sheeting which passage is enclosed by the support; and (vii) means for withdrawing the cut portion of the sheeting from the cutting area.

* * * * *

UNITED STATES PATENT AND TRADEMARK OFFICE

CERTIFICATE OF CORRECTION

PATENT NO. : 4,966,059

DATED : October 30, 1990

INVENTOR(S) : HARRY ALLAN LANDECK

It is certified that error appears in the above-identified patent and that said Letters Patent is hereby corrected as shown below:

Column 16, Line 52: Delete "A•• C°" and replace with "A°°C°".

Column 16, Line 65: Delete "A•• C°" and replace with "A°°C°".

Column 21, Line 32: Delete "Instajet TM" and replace with "Instajet™".

Signed and Sealed this

Ninth Day of February, 1993

*Attest:*

STEPHEN G. KUNIN

*Attesting Officer*

*Acting Commissioner of Patents and Trademarks*